US006354308B1

(12) United States Patent
Kuk

(10) Patent No.: US 6,354,308 B1
(45) Date of Patent: Mar. 12, 2002

(54) COSMETIC CONTAINER

(75) Inventor: Eui Ho Kuk, Inchon (KR)

(73) Assignee: Yonwoo Corporation, Inchon (KR)

( * ) Notice: Subject to any disclaimer, the term of this patent is extended or adjusted under 35 U.S.C. 154(b) by 0 days.

(21) Appl. No.: 09/628,148

(22) Filed: Jul. 28, 2000

(30) Foreign Application Priority Data

May 2, 2000 (KR) ..... 2000-12527

(51) Int. Cl.[7] ..... A45D 42/02

(52) U.S. Cl. ..... 132/301; 132/293; 132/295; 206/581

(58) Field of Search ..... 132/201, 293, 132/294, 295, 300, 303, 306, 307, 315; 220/326, 324; 206/823, 581

(56) References Cited

U.S. PATENT DOCUMENTS 4,586,519 A * 5/1986 Seidler et al. ..... 132/293
5,353,818 A * 10/1994 Suzuki et al. ..... 132/300
5,682,910 A * 11/1997 Kizawa et al. ..... 132/293
5,842,486 A * 12/1998 Davis et al. ..... 132/295
5,875,795 A * 3/1999 Bouix ..... 132/293
5,896,866 A * 4/1999 Quennessen ..... 132/293
6,055,992 A * 5/2000 Skarne ..... 132/293

* cited by examiner

*Primary Examiner*—Pedro Philogene
(74) *Attorney, Agent, or Firm*—Lahive & Cockfield, LLP

(57) ABSTRACT

A cosmetic container having an airtight structure in which dryness or deterioration of the substance can be avoided is provided. According to an aspect of the present invention, there is provided with a cosmetic container comprising a lower case and an upper case hinged to the side of the lower case, wherein an inner container is provided in the lower case and substance is filled in the inner container, and an inner cover formed with elastic material is provided at the inner surface of the upper case, so that airtightness of the container can be maintained, as the edge of the inner cover is deformed elastically and contacts closely to the periphery of the inner container when the upper and lower cases are closed.

11 Claims, 4 Drawing Sheets

COSMETIC CONTAINER

FIELD OF THE INVENTION

The invention relates to a cosmetic container and more particularly to a cosmetic container wherein dryness or deterioration of the cosmetic substance can be avoided thanks to airtight structure.

BACKGROUND OF THE INVENTION

Cosmetic such as foundation or two-way cake is generally kept in a cosmetic container so-called 'compact pack'. The container, as shown in FIG. 1, comprises a lower case 2 wherein substance 7 is filled and a buff 1 is seated above the substance 7, and an upper case 4 which is hinged to the side of the lower case 2 and the inner surface of which a mirror 3 is attached to. The upper case 4 is opened up when a button 5 formed at the front of the lower case 2 is pushed down.

By the way, in the prior cosmetic container like the above, because the upper and the lower cases 2, 4 have been formed with hard synthetic resin, when they are closed, there may be gap at their engagement. Therefore, airtightness of the container was not maintained, the cosmetic substance 7 is not only readily dried to crush during use but also deteriorated by outer atmosphere.

SUMMARY OF THE INVENTION

The present invention is created to solve the above described problems and so the object of the invention is to provide a cosmetic container wherein airtightness can be perfectly maintained, and the substance may not be readily deteriorated and the first freshness and quality of the substance can be maintained for a long time.

According to an aspect of the present invention, there is provided with a cosmetic container comprising a lower case 10 and an upper case 20 hinged to the side of the lower case 10, wherein an inner container 30 is provided in the lower case 10 and substance is filled in the inner container 30, and an inner cover 40 formed with elastic material is provided at the inner surface of the upper case 20, so that airtightness of the container can be maintained, as the edge of the inner cover 40 is deformed elastically and contacts closely to the periphery of the inner container 30 when the upper and the lower cases 10, 20 are closed.

DETAILED DESCRIPTION OF THE INVENTION

A preferred embodiment of the invention will be described in detail below by referring to the accompanying drawings.

Figure 1:
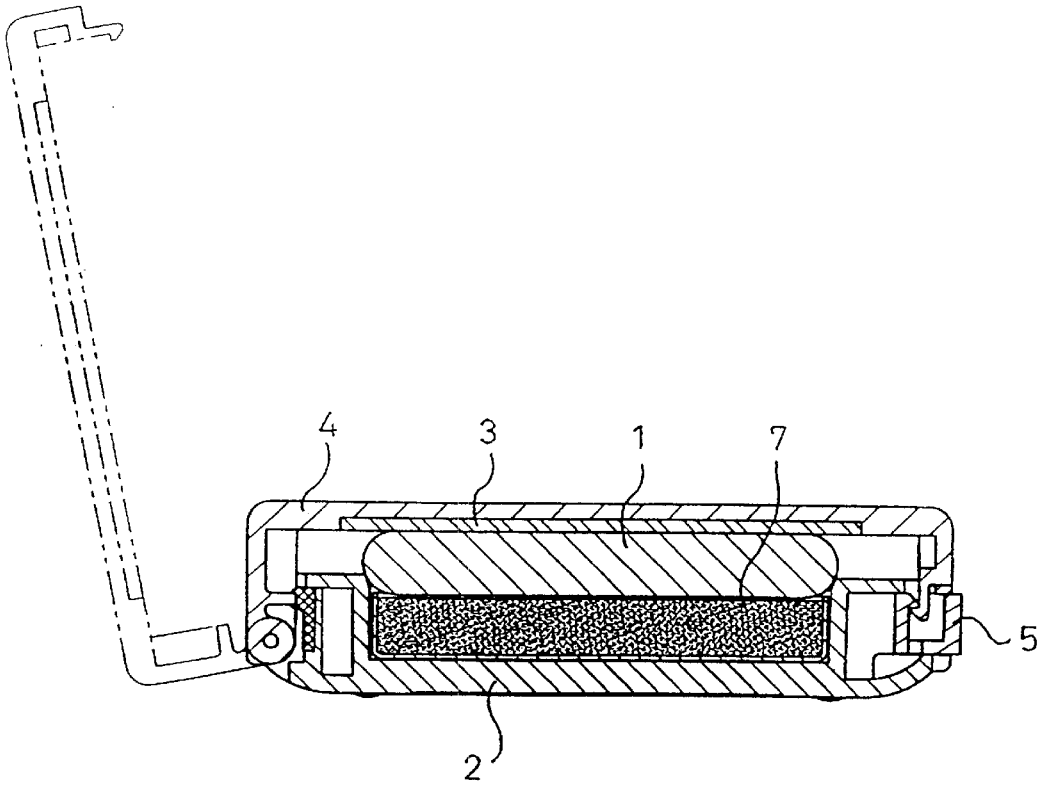
FIG. 1 PRIOR ART
FIG. 1 shows a cross-sectional view of a prior cosmetic container.
Figure 2:
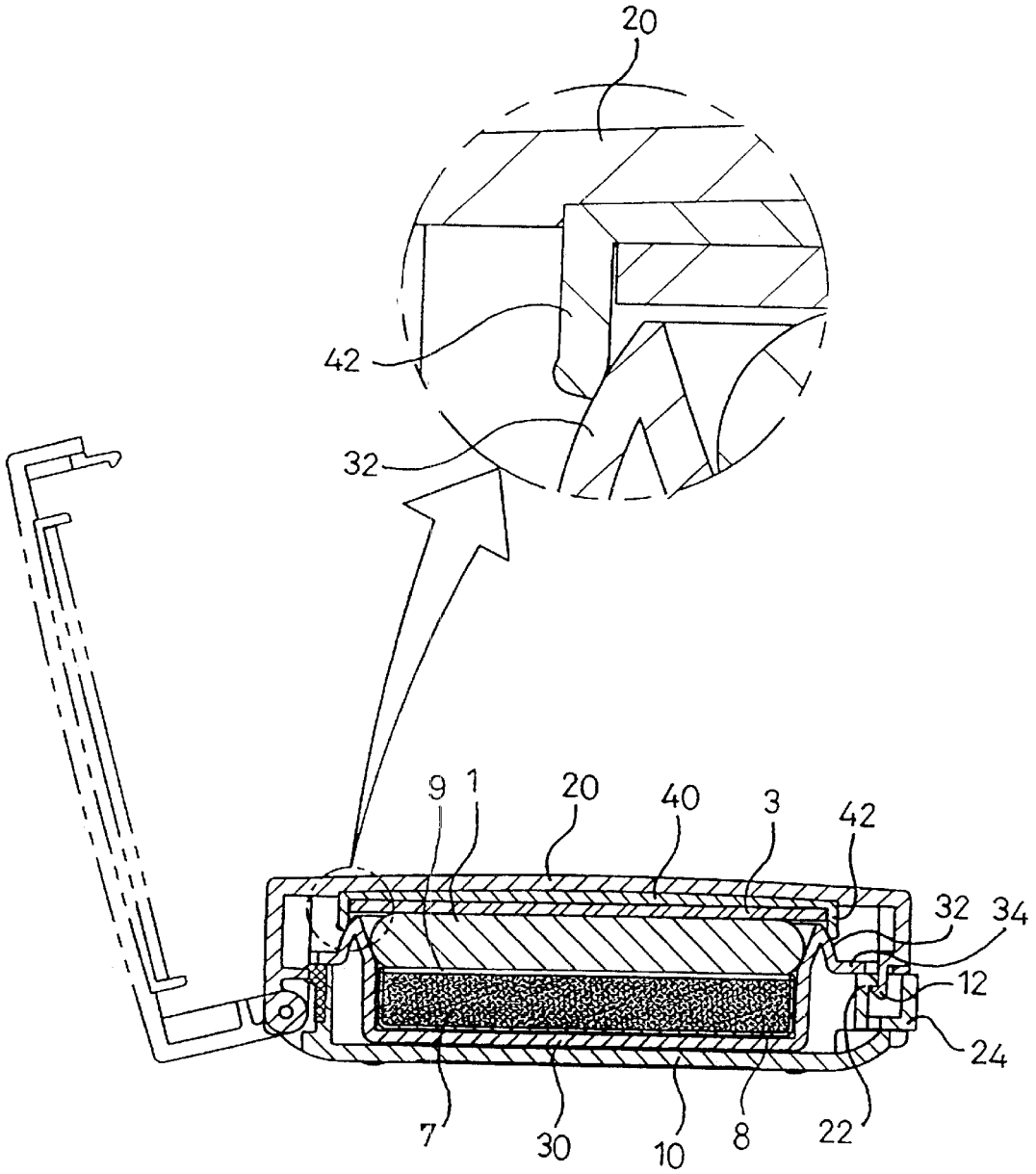
FIG. 2 shows a cross-sectional view of a cosmetic container according to a preferred embodiment of the present invention.
Figure 3:
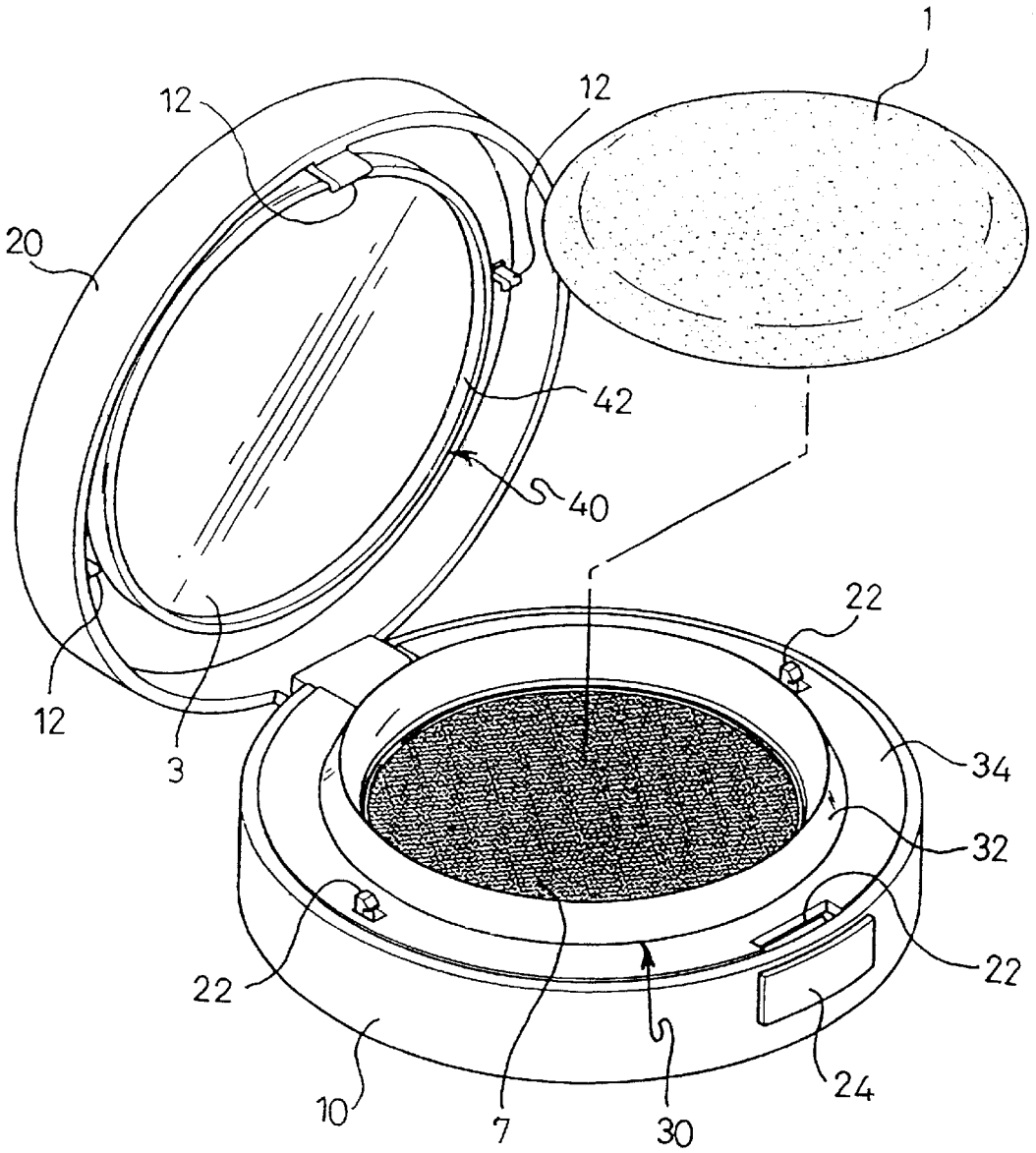
FIG. 3 shows a perspective view of the above embodiment.

FIG. 2 and FIG. 3 show respectively a perspective view and a cross sectional view of a preferred embodiment of the invention.

A cosmetic container according to the invention includes a lower case 10, an upper case 20, an inner container 30 in the lower case 10, and an inner cover 40 which is provided at the inner surface of the upper case 20 and makes the inner container 30 airtight, and airtightness of the container is maintained by the engagement of the inner cover 40 and the inner container 30.

The upper case 20 is hinged to the side of the upper case 10. As shown in FIG. 3, the upper and the lower cases 20, 10 can be formed with a variety of shapes such as circular, oval or square. Here, engaging projection 12 is downdards protruded at the lower end of the front of the upper case 20, and a button 24 having an engaging hook 22 coupled to the engaging projection 12 is provided at the front of the lower case 10. As a result, when the button 24 is pushed down, the engaging projection 12 and the engaging hook 22 are disengaged from each other and the upper case 20 is opened up.

If necessary, the cosmetic container can be more airtightly closed by making the upper case 10 locked with the lower case 20 at a plurality of locations.

Furthermore, in the lower case 10, an inner container 30 formed with synthetic resin or metal is provided, and the inner surface of it is attached to the bottom of the lower case 10, cosmetic substance 7 is filled in the inner container 30, and a buff 1 is placed on the upper surface of the substance 7. Here, a thin film may be placed between the substance 7 and the buff. It is preferable to put the substance 7 into another sub-container and put it into the inner container 30.

Meanwhile, an inclined outer wall 32 is formed along the upper edge of the inner container 30, and a flange 34 is horizontally extended from the lower end of the outer wall 32. And the flange 34 is seated on the upper surface of the lower case 10 when the upper case 20 and the lower case 10 are closed.

And, an inner cover 40 formed with elastic materials such as silicon rubber is attached to the inner surface of the upper case 20. A mirror 3 is provided at the inner surface of the inner cover 40, and the inner cover 40 is attached to the inner surface of the upper case 20. A side wall 42 is extended downwards along the edge of the inner case 40. As a result, airtightness of the inner container 30 can be maintained because, when the upper and the lower cases 10, 20 are closed, the end of the side wall 42 is deformed elastically and contacts closely to the outer wall 32 of the inner container 30.

Figure 4:
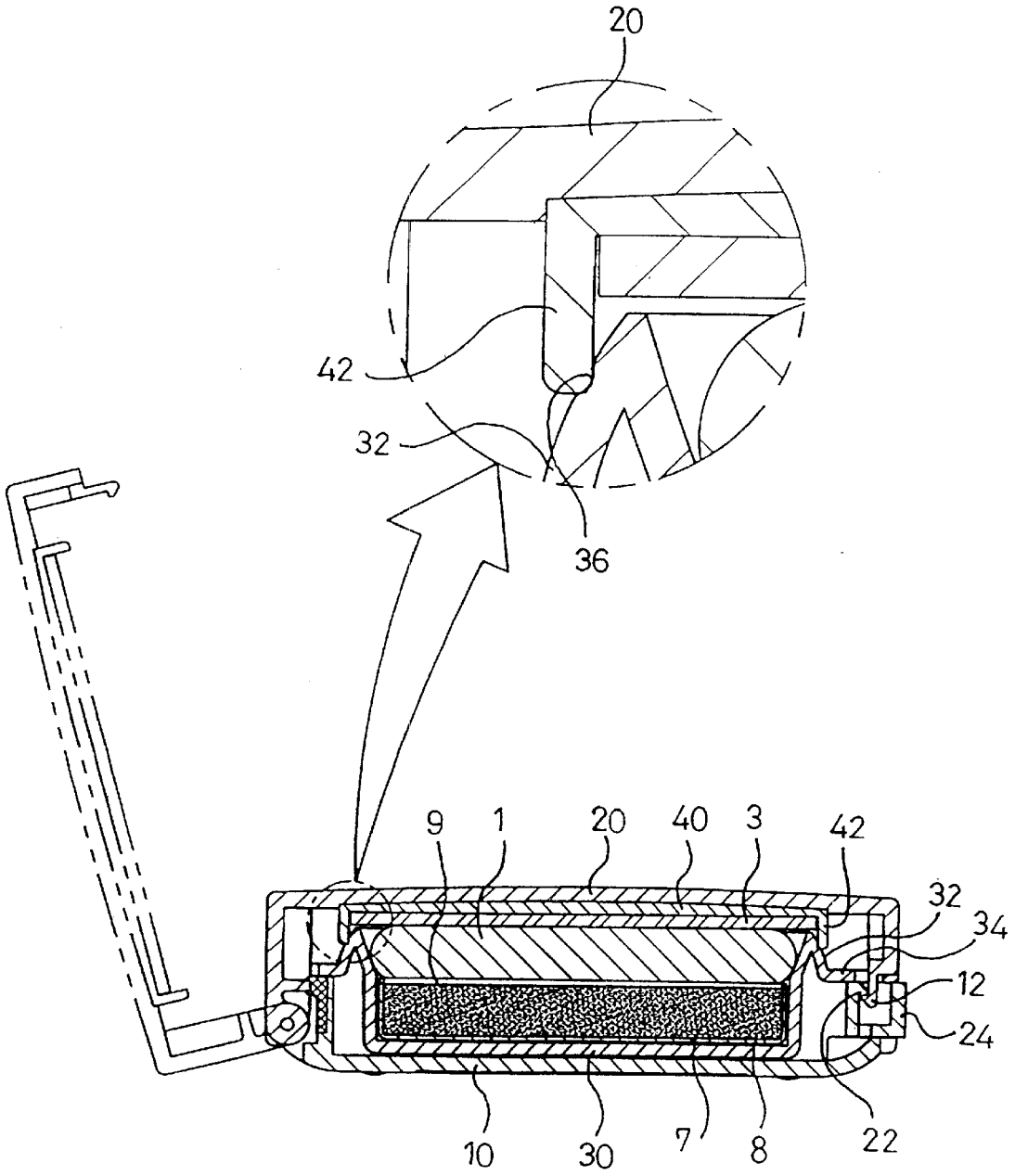
FIG. 4 shows another preferred embodiment of the present invention.

FIG. 4 shows another preferred embodiment of the invention. Referring to the drawing, a groove 36 is formed along the outer wall 32 of the inner container 30, and the end of the side wall 42 of the inner cover 40 is fitted in the groove 36. Thanks to the above groove 36, the inner cover 40 and the inner container 30 are more airtightly closed, and furthermore it is avoided that the lower end of the inner cover 40 is pressed around the outer edge of the inner container 30 and deformed.

Therefore, in a cosmetic container according to the invention, airtightness of the container can be maintained, and accordingly dryness or deterioration of the cosmetic substance can be avoided because the end of the inner cover 40 is deformed elastically and contacts closely and airtightly to the inner container 30 when the upper and the lower cases 10, 20 are closed.

As described above, a cosmetic container can be provided wherein the first freshness and quality of the substance can be maintained for a long time because airtightness of the container is maintained, and deterioration of the substance can be readily avoided as a result.

What is claimed is:

1. Cosmetic container comprising a lower case and an upper case hinged to the side of the lower case, wherein a rigid inner container having an inclined outer wall is provided in the lower case and a substance is filled in the rigid inner container, and an inner cover formed with elastic material is provided at the inner surface of the upper case, so that airtightness of the container can be maintained, as the edge of the inner cover is deformed elastically and contacts closely the inclined outer wall of the inner container when the upper and the lower cases are closed.

2. The cosmetic container of claim 1, wherein the rigid inner container further comprises a flange extending horizontally from the lower end of the inclined outer wall, and wherein the flange is seated on an upper surface of the lower case.

3. The cosmetic container of claim 1, wherein the upper case further comprises a projection and the lower case comprises a hook for engaging the projection to lock the upper case to the lower case.

4. The cosmetic container of claim 3, further comprising a button on the lower case for unlocking the hook from the projection to open the cosmetic container.

5. The cosmetic container of claim 3, further comprising a plurality of engaging projections located at a plurality of different locations on the upper case and a plurality of engaging hooks located at a plurality of different locations on the lower case corresponding to the plurality of different locations on the upper case for locking the upper case to the lower case at a plurality of locations.

6. The cosmetic container of claim 1, wherein the rigid inner container formed of synthetic resin or metal.

7. The cosmetic container of claim 1, further comprising a thin film covering the substance.

8. The cosmetic container of claim 1, further comprising a sub-container containing the substance, wherein the sub-container is inserted in the rigid inner container.

9. The cosmetic container of claim 1, further comprising a mirror located on an inner surface of the inner cover.

10. The cosmetic container of claim 1, wherein the edge of the inner cover extends along the inclined outer wall when the upper and lower cases are closed.

11. A cosmetic container comprising:

a lower case;

an upper case hinged to the side of the lower case;

an inner container provided in the lower case for holding a substance and having an inclined outer wall including a groove;

an elastic inner cover provided at the inner surface of the upper case and including an elastically deformable edge, wherein the elastically deformable edge is fitted in the groove when the upper and the lower cases are closed.

* * * * *